US005718383A

United States Patent [19]

Smith et al.

[11] Patent Number: 5,718,383

[45] Date of Patent: Feb. 17, 1998

[54] VISCOUS LIQUID SPRAY DISPENSING SYSTEMS

[75] Inventors: Robert Smith, Ballwin, Mo.; John Shively, Williamsport, Pa.

[73] Assignee: Par Way Group, St. Clair, Mo.

[21] Appl. No.: 608,663

[22] Filed: Feb. 29, 1996

[51] Int. Cl.[6] ..... B05B 1/26; B05B 9/043; B65D 1/32; B65D 37/00

[52] U.S. Cl. ..... 239/272; 239/327; 239/333; 239/543; 222/82; 222/92

[58] Field of Search ..... 239/195, 271, 239/272, 302, 309, 327, 328, 333, 375, 377, 525, 526, 543; 222/81, 82, 95, 92, 105, 107, 372, 383.1, 527, 529

[56] References Cited

U.S. PATENT DOCUMENTS

| | | | |
|---|---|---|---|
| 3,061,202 | 10/1962 | Tyler | 239/33 |
| 3,245,582 | 4/1966 | Roth . | |
| 3,342,377 | 9/1967 | Peredy . | |
| 4,011,992 | 3/1977 | Olsen | 239/135 |
| 4,138,036 | 2/1979 | Bond . | |
| 4,159,789 | 7/1979 | Stoody . | |
| 4,159,790 | 7/1979 | Bailey . | |
| 4,614,284 | 9/1986 | Miles . | |
| 4,621,750 | 11/1986 | Roethel | 222/505 |
| 4,702,267 | 10/1987 | Ashraff | 239/271 X |
| 5,004,123 | 4/1991 | Stoody . | |
| 5,031,798 | 7/1991 | Wild . | |
| 5,088,649 | 2/1992 | Hanson . | |
| 5,156,299 | 10/1992 | DeCaluwe . | |
| 5,244,125 | 9/1993 | Robbins . | |
| 5,249,747 | 10/1993 | Hanson et al. | 222/373 |
| 5,257,865 | 11/1993 | Tani . | |
| 5,273,186 | 12/1993 | Widmer . | |
| 5,305,920 | 4/1994 | Reiboldt . | |
| 5,328,055 | 7/1994 | Battle . | |
| 5,334,180 | 8/1994 | Adolf et al. | 222/81 X |
| 5,337,921 | 8/1994 | Wilson . | |
| 5,360,145 | 11/1994 | Gueret . | |
| 5,377,875 | 1/1995 | Kock . | |
| 5,411,176 | 5/1995 | Favre . | |
| 5,421,485 | 6/1995 | Furuta . | |
| 5,429,254 | 7/1995 | Christine . | |
| 5,429,273 | 7/1995 | King . | |
| 5,474,212 | 12/1995 | Ichikawa . | |
| 5,492,275 | 2/1996 | Crampton . | |
| 5,531,358 | 7/1996 | Corella | 222/107 |

OTHER PUBLICATIONS

The QC/D Quick Connect/Disconnect Pump–Out System.
Powdered Condiment Dispensing Seriers 300.
Powered Condiment Dispensing Series 400.
Perfect Condiment Dispensing From Perfection.

*Primary Examiner*—Andres Kashnikow
*Assistant Examiner*—Robin O. Evans
*Attorney, Agent, or Firm*—James A. Quinton, Esq.

[57] ABSTRACT

A system of dispensing viscous liquid, such as vegetable oil containing products is provided which includes a sealed flexible barrier pack filled with viscous liquid, preferably filled with a viscous liquid oil having a viscosity of about 60 cps or greater. The flexible barrier pack includes a sealed fluid outlet located in the sealed flexible barrier pack. A manual pump sprayer preferably a hand pump sprayer of the trigger type is provided for delivering vegetable oil from the flexible barrier pack to a pre-selected surface such as a griddle in a fast food restaurant. Desirably, the hand pump sprayer includes a first and second discharge outlet to discharge pressurized liquid to the atmosphere along intersecting discharge axes.

22 Claims, 5 Drawing Sheets

VISCOUS LIQUID SPRAY DISPENSING SYSTEMS

BACKGROUND OF THE INVENTION

1. Field of the Invention

The field of the invention is viscous liquid spray dispensing systems.

2. Description of the Prior Art

Vegetable oil containing products have been in widespread use for cooking and baking. However, due to their high viscosity, vegetable oils containing products have presented application problems. In the modern restaurant, heating surfaces such as griddle surfaces are often used in the preparation of food. These surfaces are often lubricated with a cooking oil such as a vegetable oil, for example, sunflower oil, corn oil, coconut oil, canola oil, olive oil, soybean oil, other cooking oils or a mixture of oils. Typically, in the prior art, the vegetable oil is ladled onto the grill. This is a particularly undesirable practice. Much more vegetable oil is applied to the cooking surface than is necessary for the cooking process. Often the oil is spread with a brush which can result in bristles contaminating the food. Alternatively, the vegetable oil can be dispensed from aerosol containers or bottles having hand pump sprayers. However, both these methods of packaging are expensive and can require the disposal of a large number of containers which increases the volume of trash that must be disposed of by the restaurant. Useful in the prior art in dispensing viscous vegetable oil products is a manual pump sprayable dispensing system as shown in U.S. Pat. No. 5,088,649 (Hanson). According to the Hanson patent, pressurized viscous vegetable oil is delivered to the nozzle of a sprayer which discharges the vegetable oil along two intersecting discharge axes.

Powered condiment dispensers have been provided. Such powered dispensers use a bag in a box condiments and powered pumps within 50 feet of the dispenser. For example, the Perfection Fluid Series 300 and 400. Such systems use a powered pump and a $CO_2$ compressor to deliver globs of condiments to a fixed location from barrier packed containers.

SUMMARY OF THE INVENTION

The present invention is directed to an improved viscous liquid spray dispensing system. More particularly the invention is related to an improved vegetable oil spray dispensing system. According to the invention, a system of dispensing viscous liquid, such as vegetable oil is provided which includes a sealed flexible barrier pack filled with viscous liquid, preferably filled with a viscous liquid oil having a viscosity of about 60 cps or greater. The flexible barrier pack includes a sealed fluid outlet located in the sealed flexible barrier pack. A manual pump sprayer preferably a hand pump sprayer of the trigger type is provided for delivering vegetable oil from the flexible barrier pack to a pre-selected surface such as a griddle in a fast food restaurant. Desirably, the hand pump sprayer includes a first and second discharge outlet to discharge pressurized liquid to the atmosphere along intersecting discharge axes. The discharge axes intersect at a collision point exterior to the first and second discharge outlets.

As a result, liquid exiting the hand pump sprayer nozzle collides. This results in a break up of the liquid into small droplets to form a wide angle mist for application to the preselected surface. A flexible conduit is attached to the hand pump sprayer. The conduit has a connector at the inlet end of the conduit which is adapted for leak proof engagement and opening of the sealed fluid outlet in the flexible barrier pack to allow vegetable oil to flow through the fluid outlet to the flexible conduit upon activation of the manual pump sprayer. At the conduit outlet end, the conduit interconnects with the hand pump sprayer.

It is an object of the invention to provide a viscous liquid dispensing system which allows controlled dispensing preselected amounts of the viscous liquid to a preselected surface.

It is an object of the invention to provide a vegetable oil spray dispensing system which allows controlled dispensing of vegetable oil to a cooking surface.

It is an object of the invention to provide a vegetable oil dispensing system which is efficiently packaged and reduces trash generated from the packaging.

It is an object of the invention to provide a vegetable oil dispensing system which can be conveniently located in a small space near the cooking surface while at the same time having a large capacity.

It is an object of the invention to provide an economical vegetable oil dispensing system for dispensing controlled preselected amounts of vegetable oil to a cooking surface in a fine mist.

Other further objects will become apparent from the specification, drawings and claims.

The preferred embodiment of the present invention is illustrated in the drawings and examples. However, it should be expressly understood that the present invention should not be limited solely to the illustrative embodiment.

DETAILED DESCRIPTION OF THE INVENTION

According to the invention, a system of dispensing viscous liquid, such as vegetable oil is provided which includes a sealed flexible barrier pack filled with the viscous liquid, preferably a vegetable oil containing liquid preferably filled with a viscous vegetable oil containing liquid having a viscosity of about 60 cps or greater.

More preferably, the liquid viscosity is about 60 cps to about 100 cps. Most preferably, the liquid viscosity is from 60 cps to about 85 cps. Desirably, the flexible barrier pack contains a relatively large volume of liquid from about ¼ gallon to about gallons preferably about ½ gallon to about 1 gallon, most preferably about ½ gallon. The flexible barrier pack includes a sealed fluid outlet located in the sealed flexible barrier pack. A manual pump sprayer preferably a hand pump sprayer, most preferably of the trigger type is provided for delivering vegetable oil from the flexible barrier pack to a pre-selected surface such as a griddle in a fast food restaurant. Desirably, the hand pump sprayer includes a first and second discharge outlet to discharge pressurized liquid to the atmosphere along intersecting discharge axes. The first and second discharge axes intersect at a collision point exterior to the first and second discharge outlets. As a result, liquid exiting the first discharge outlet collides with liquid exiting the second discharge outlet. This results in a break up of the liquid into small droplets to form a wide angle mist for application to a preselected surface. A flexible conduit is attached to the hand pump sprayer. The conduit has a connector at the inlet end of the conduit which is adapted for leak proof engagement and opening the sealed fluid outlet in the flexible barrier pack to allow viscous liquid to flow through the fluid outlet to the flexible conduit upon activation of the hand pump sprayer. At the conduit outlet end, the conduit interconnects with the inlet to the hand pump sprayer.

According to the invention, a system for spray dispensing viscous liquids in a fine mist is provided. Preferably, the liquid is a viscous vegetable oil or vegetable oil containing product, such as sunflower or canola oil or a vegetable oil lecitin mixture. Other vegetable oils that can desirably be used include corn oil, coconut oil, olive oil, soybean oil or other cooking oils or a mixture thereof along with flavoring, spices, colorings or other additives, e.g. starch.

Figure 1:
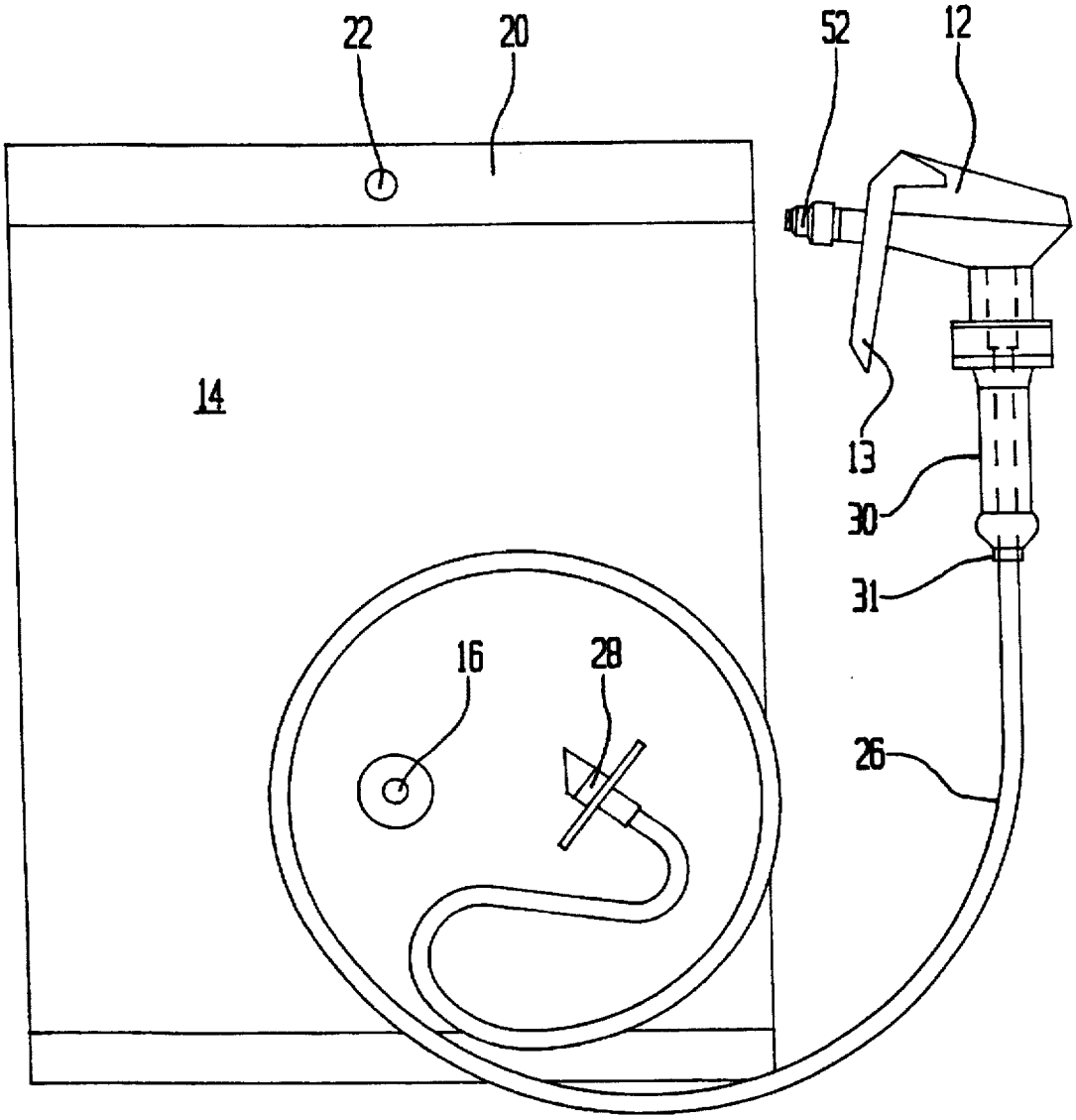
FIG. 1 is a perspective view of the flexible barrier pack and sprayer according to the invention is disconnected.
Figure 2:
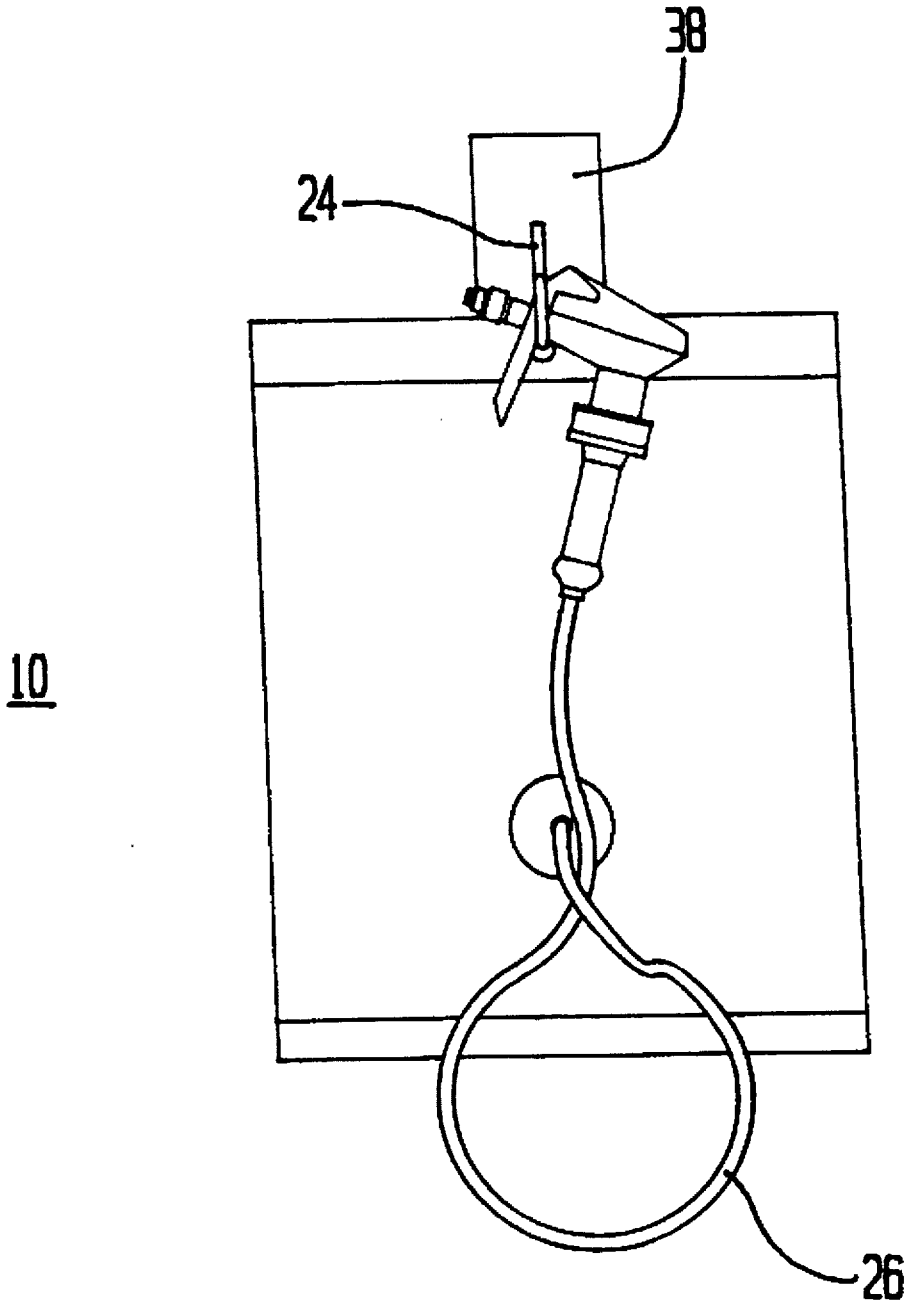
FIG. 2 is a perspective view of the viscous liquid dispensing system according to the invention mounted to a vertical surface.
Figure 3:
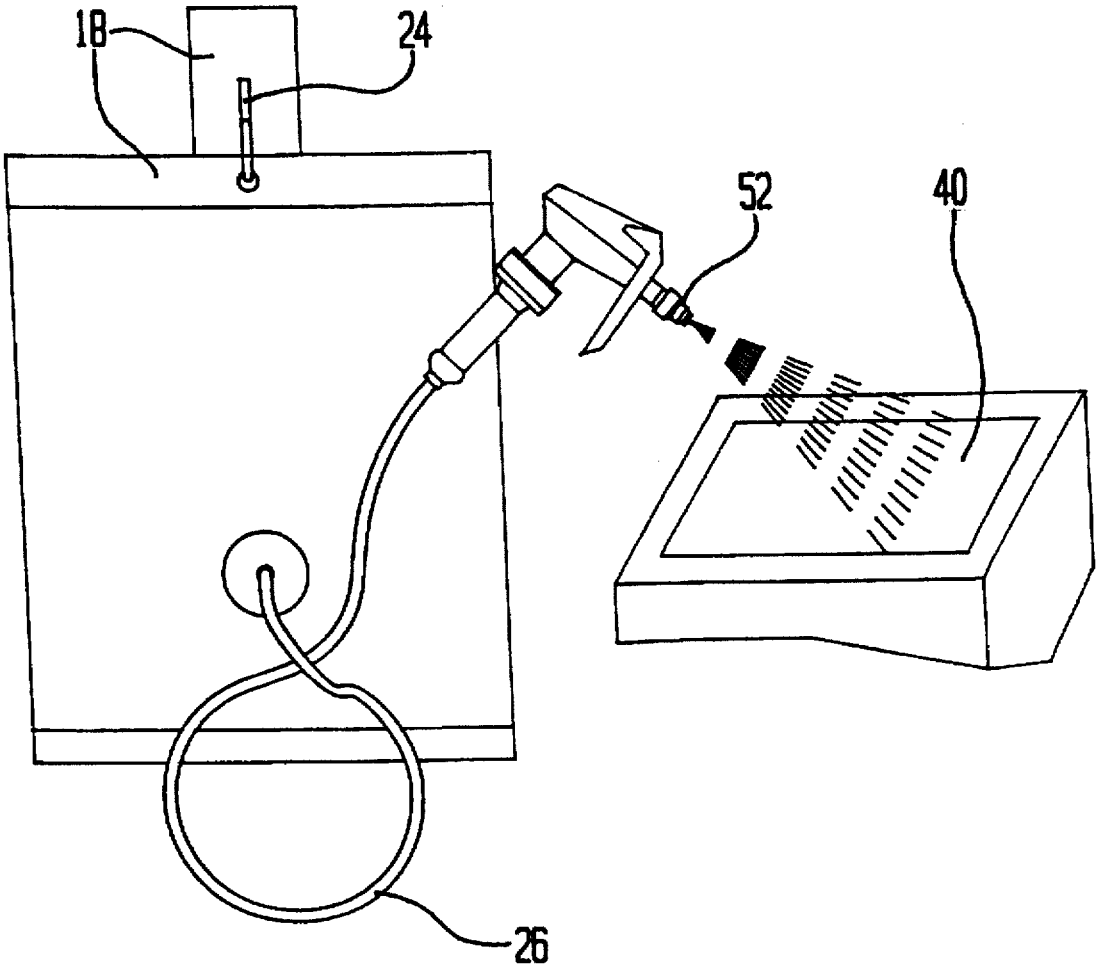
FIG. 3 is a perspective view of the viscous liquid dispensing system according to the invention in use.
Figure 4:
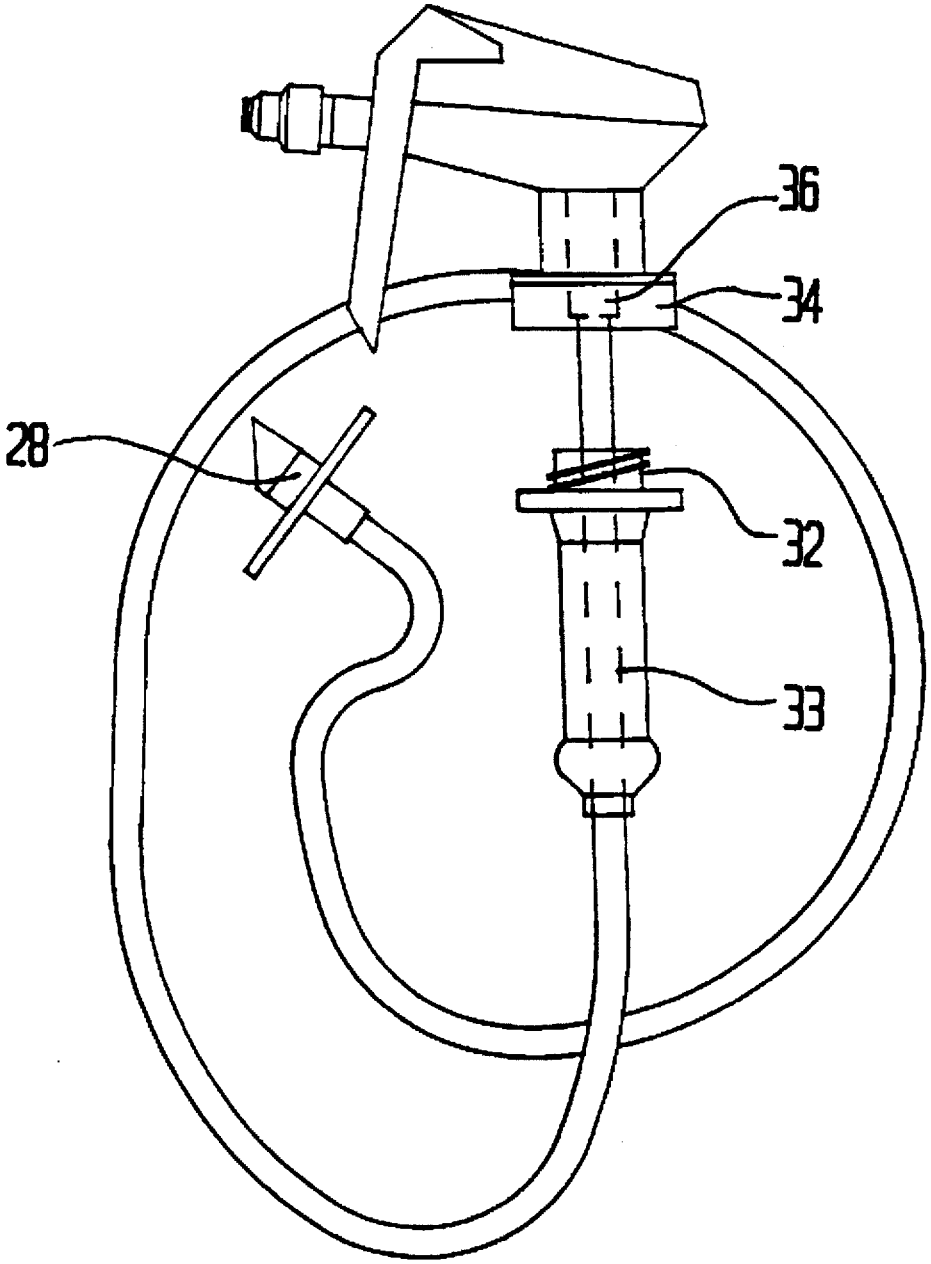
FIG. 4 is a perspective partially exploded view of the sprayer and flexible conduit according to the invention.
Figure 5:
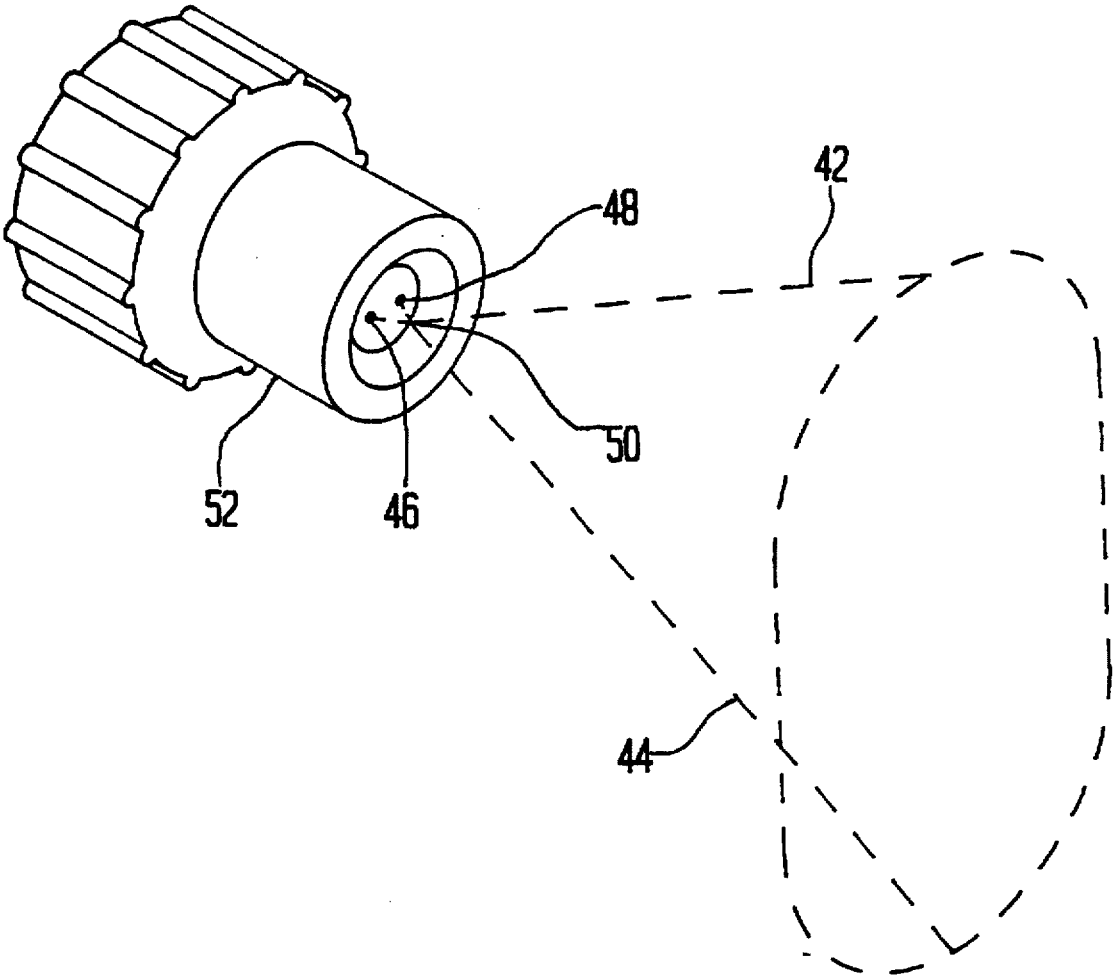
FIG. 5 is an isometric view of the nozzle of the invention according to the invention during spraying.

Referring now, to FIGS. 1 through 5, a vegetable oil dispensing system 10 is provided. It includes a manual pump sprayer, preferable a hand pump sprayer 12 having a trigger 13. Most desirably, the hand pump sprayer is the type shown in U.S. Pat. No. 5,088,649 which is incorporated by reference and which provides a hand pump sprayer having colliding outlet streams. Alternatively, a nozzle as shown in U.S. Pat. No. 5,492,275 may be used.

According to the invention, a hand pump sprayer 12 has a first discharge outlet 46 and second discharge outlet 48 in nozzle 52 to dispense pressurized fluid to the atmosphere along a first discharge axis 42 and second discharge axis 44. The first and second discharge axes intersect at a collision point 50 exterior to the first and second discharge outlets 46 and 48. As a result, the discharging viscous liquid, preferably viscous vegetable oil breaks up at the collision point 50 to small droplets to form a wide angle mist for application to a preselected surface, preferably a cooking surface 40. A flexible barrier pack 14 is provided having an outlet 16. There are numerous barrier packs that will suffice. Desirably, a barrier pack made with the Cryovac Model 2050 vertical form fill and seal machine is desirable. The resulting flexible barrier pack can be made of a variety of barrier film. Preferably, a three layer barrier pack can be used. Desirably, a barrier pack composed of a nylon core layer sandwiched between linear low density polyethylene layers on both sides is used, for example, CRYOVAC FILM FS 6050.

Preferably, a vertical mounting system 18 is provided. The mounting system can desirably include a plastic or cardboard horizontal strip 20 either attached or integral with barrier pack 14 which reinforces the top of the flexible barrier pack 14. A mounting hole 22 is provided in the top of barrier pack 14 for cooperation with a mounting hook or peg 24 which is attached to a convenient vertical surface for mounting the flexible barrier pack 14 adjacent to a preselected surface, preferably, a cooking surface. Optionally a plastic or cardboard strip can be attached to the top of the barrier pack having a mounting hole in the strip which extends above the top of the pack. Barrier pack 14 includes an outlet 16 which is flexibly connected to hand pump sprayer 12, preferably through a long, flexible plastic conduit, most preferably a long, plastic tube 26 having a preselected length so the manual pump sprayer can deliver the viscous liquid to the preselected surface. The length of the tube is typically 3' to 6', preferably about 4.5'. Outlet 16 is sealed upon manufacture of flexible barrier pack 14. At the inlet end of the long flexible conduit 26 is a connector 28 which matingly interacts with sealed outlet 16 to break the seal and form a leak resistant connection between the plastic tube 26 and the flexible barrier pack 14.

Preferably, a cylindrical hand hold 30 is provided for engagement with hand pump sprayer 12. Desirably, flexible conduit 26 slides through hand hold connector 30 through inlet passageway 31 which snugly receives flexible conduit 26. Flexible conduit 26 extends through hand hold 30 and mounts onto tube inlet 36 in the hand pump sprayer for a snug, leak proof connection. Hand hold 30 has an cylindrical union 32, on its outlet end which preferably includes threads for engagement with threads located in cylindrical inlet 34 of hand pump sprayer 12. Desirably, hand hold 30 has a large interior cavity 33. Any liquid leakage from sprayer 12 is retained within hollow interior cavity 33.

In use, a dispensing system for spraying a viscous liquid, preferably a vegetable oil in controlled amounts is provided. According to the invention, a peg or hook, preferably hook 24 is mounted to a vertical surface through mounting bracket 38. The flexible barrier pack 14 is then mounted to a preselected vertical surface by use of the vertical mounting system 18 which consists of a strip 20, preferably made of plastic or cardboard and a mounting hole 22 which is provided at the top of flexible barrier pack 14. The bag is then mounted onto peg or hook 24, which has been affixed to a vertical surface adjacent to the preselected surface preferably, a convenient cooking surface by affixing bracket 38 to the vertical surface. Desirably, a hand pump sprayer 12 can also be hung up on hook 24 for neat, convenient storage when not in use.

The resulting spray dispensing system provides a system for dispensing viscous liquids in controlled amounts to a pre-selected surface. According to the invention, a viscous liquid, preferably vegetable oil spray dispensing system is provided, which allows controlled spray dispensing of viscous vegetable oils to a preselected surface, preferably a cooking surface in small droplets to form a wide angle mist. When the pump sprayer 12 is engaged, liquid is drawn from the flexible barrier pack 14 through tube 26 and expelled under pressure to the atmosphere along colliding discharge axes 42 and 44.

Storage of the filled bag is simple and space efficient since the filled flexible barrier packs can be stacked on top of one another and neatly packaged in a box or other container. The flexible barrier pack can be sized as required. Preferably ¼ gallon to 5 gallon packs are provided. According to the invention, when the flexible barrier packs are exhausted, these results in a reduced volume of trash generated as opposed to bottles or aerosol containers. The used flexible barrier packs can be placed one on top of another and compressed to occupy a small amount of space in a dumpster or refuse site. The system according to the invention sprays a viscous liquid, preferably a vegetable oil in a fine mist in a preselected controlled amount. The system itself can be conveniently located in a small space near the surface to which the viscous liquid, preferable vegetable oil is to be applied. As a result, an effective spray dispensing system for liquids is provided.

The foregoing is considered as illustrative only to the principles of the invention. Further, since numerous changes and modifications will occur to those skilled in the art, it is not desired to limit the invention to the exact construction and operation shown and described above, and accordingly all suitable modifications and equivalents may be resorted to, falling within the scope of the invention.

We claim:

1. A system for spraying a viscous liquid in a fine mist comprising:

a) a viscous liquid;

b) a sealed flexible barrier pack filled with said viscous liquid;

c) a sealed fluid exit located in said sealed flexible barrier pack;

d) a manual pump sprayer for delivering pressurized liquid from said flexible barrier pack to a pre-selected surface;

said manual pump sprayer have an inlet means and an outlet means;

e) a flexible conduit having a conduit inlet and a conduit outlet;

f) said conduit outlet interconnecting with said manual pump sprayer inlet means;

g) said conduit inlet including a connector means for engagement with and opening said sealed fluid outlet in said flexible barrier pack to allow liquid to flow through said fluid outlet to said flexible conduit upon activation of said manual pump sprayer.

2. A system for dispensing viscous liquid according to claim wherein said flexible conduit is a long, plastic tube.

3. A system for dispensing viscous liquid according to claim 1 further comprising mounting means to mount said sealed flexible barrier pack adjacent to said preselected surface.

4. A system for dispensing viscous liquid according to claim 3 wherein said mounting means includes a hook; means to securely fasten said hook to a vertical surface located adjacent to said preselected surface; and a hook engagement means securely attached to said flexible barrier pack.

5. A system for dispensing viscous liquid according to claim 4 wherein said preselected surface is a cooking surface and said vertical surface is a vertical wall adjacent to said cooking surface.

6. A system for dispensing viscous liquid according to claim 5 wherein said liquid has a viscosity of about 60 cps or greater.

7. A system for dispensing viscous liquid according to claim 6 wherein said liquid has a viscosity of about 60 cps to about 85 cps.

8. A system according to any one of claims 1 to 7 wherein said viscous liquid is a vegetable oil containing viscous liquid.

9. A system for dispensing viscous liquid according to any one of claims 1 to 7 wherein said manual spray is a hand pump sprayer of the trigger type.

10. A system for spraying a viscous liquid in a fine mist comprising:

a) viscous liquid;

b) a sealed flexible barrier pack filled with said viscous liquid;

c) a sealed fluid exit located in said sealed flexible barrier pack;

d) a manual pump sprayer for delivering pressurized liquid oil from said flexible barrier pack to a preselected surface;

said manual pump sprayer having an inlet means and an outlet means;

e) said manual pump sprayer outlet means including a first and second discharge outlet to discharge pressurized liquid to the atmosphere along a first and second discharge axis; said axes intersecting at a collision point exterior to said first and second discharge outlets to break up the liquid into small droplets and form a wide angle mist for application to said preselected surface;

f) a flexible conduit having a conduit inlet and a conduit outlet;

g) said conduit outlet interconnecting with said manual pump sprayer inlet means;

h) said conduit inlet including a connector means for engagement with and opening said sealed fluid outlet in said flexible barrier pack to allow liquid to flow through said fluid outlet to said flexible conduit upon activation of said manual pump sprayer.

11. A system for dispensing viscous liquid according to claim 10 wherein said manual pump sprayer is a hand pump sprayer of the trigger type.

12. A system for dispensing viscous liquid according to claim 11 wherein said viscous liquid is a vegetable oil containing viscous liquid having a viscosity of about 60 cps to about 100 cps.

13. A system for dispensing viscous liquid according to claim 12 wherein said viscous liquid is a vegetable oil containing viscous liquid having a viscosity of about 60 cps to about 85 cps.

14. A system for dispensing viscous liquid according to claim 12 wherein said flexible conduit is a long, plastic tube.

15. A system for dispensing viscous liquid according to claim 12 further comprising mounting means to mount said sealed flexible barrier pack adjacent to said preselected surface; and means to mount said hand pump sprayer adjacent said sealed flexible barrier pack when said hand pump sprayer is not in use.

16. A system for dispensing viscous liquid according to claim 15 wherein said mounting means includes a hook securely fastened to a vertical surface located adjacent to said preselected surface; and a hook engagement means securely attached to said flexible barrier pack.

17. A system for dispensing viscous liquid according to claim 16 wherein said preselected surface is a cooking surface and said mounting wall is a vertical wall adjacent said cooking surface.

18. A system for dispensing viscous liquid according to claim 17 wherein said flexible barrier pack holds from about 0.5 to about 5.0 gallons of liquid.

19. A system for dispensing viscous liquid according to claim 18 wherein said flexible barrier back hold from about 0.5 gallons to about 1.0 gallons.

20. A system for dispensing viscous liquid according to claim 1 wherein said viscous liquid has a viscosity of about 60 cps or greater.

21. A system for dispensing viscous liquid according to claim 1 wherein said viscous liquid has a viscosity of about 60 cps to about 100 cps.

22. A system for dispensing viscous liquid according to claim 1 wherein said viscous liquid has a viscosity of about 60 cps to about 85 cps.

* * * * *